US005088707A

United States Patent [19]

Stemmler

[11] Patent Number: 5,088,707

[45] Date of Patent: Feb. 18, 1992

[54] METHOD AND APPARATUS FOR THE PRODUCTION OF NUMERICALLY CORRECT STACKS

[75] Inventor: Kurt Stemmler, Neuwied, Fed. Rep. of Germany

[73] Assignee: Winkler & Dunnebier Maschinenfabrik und Eisengiesserei KG, Neuwied, Fed. Rep. of Germany

[21] Appl. No.: 565,231

[22] Filed: Aug. 9, 1990

[30] Foreign Application Priority Data

Aug. 19, 1989 [DE] Fed. Rep. of Germany ..... 3927422

[51] Int. Cl.[5] ..... B41L 1/32

[52] U.S. Cl. ..... 270/39; 270/32

[58] Field of Search ..... 270/31, 32, 39, 40, 270/41, 47, 52, 52.5, 95; 493/351, 360–363, 409, 412–417, 405

[56] References Cited

U.S. PATENT DOCUMENTS 4,717,135 1/1988 Hathaway ..... 270/39
4,770,402 9/1988 Couturier ..... 270/39
4,778,441 10/1988 Couturier ..... 493/425
4,824,426 4/1989 DuFresne ..... 493/346

FOREIGN PATENT DOCUMENTS 89163 7/1980 Japan ..... 270/39

*Primary Examiner*—Edward K. Look
*Assistant Examiner*—Therese M. Newholm
*Attorney, Agent, or Firm*—Collard, Roe & Galgano

[57] ABSTRACT

A method and apparatus for producing numerically correct partial stacks from individual leaves or sheets interfolded in a U-shaped or zigzag form on an interfolder. A double stream is formed from one or more streams of sheets by staggering or guiding together. This double stream is then continuously folded into zigzag form and piled up in a continuously growing stack, from which partial stacks of a specific size are separated. Gaps are formed in the streams of sheets which simplify the introduction of separating elements into the stack. For this purpose, sheets are removed from the streams of sheets and optionally placed accurately in position on successive sheets.

19 Claims, 6 Drawing Sheets

METHOD AND APPARATUS FOR THE PRODUCTION OF NUMERICALLY CORRECT STACKS

BACKGROUND OF THE INVENTION

1. Field of the Invention

The present invention relates to a method and apparatus for producing numerically correct partial stacks from individual leaves or sheets interfolded in a U-shape or a zigzag form on an interfolder. A double stream is formed from one or more streams of sheets by staggering or guiding together the streams. This double stream is then continuously folded in a zigzag form and is piled up in a continuously growing stack, from which partial stacks of a specific size are separated. Gaps are formed in the streams of sheets which simplify the introduction of separating elements into the stack. For this purpose, sheets are removed from the streams of sheets and optionally placed accurately in position on successive sheets.

2. The Prior Art

An apparatus of this type is known to those skilled in the art as an interfolder and have been known for a long time. They function by folding material into U-shaped or zigzag-shaped folds, and for producing stacks of folded sheet material. During this method of operation, one common stream of sheet material is formed from one or more, preferably two, prepared lengths of material which each consists of an uninterrupted series of sheets of equal length which are separated from one another or are attached to one another by a perforation. The single stream of sheet thus produced is then folded in a zigzag format and is then piled up in a stack.

Depending upon the number of folds per sheet, the common stream of sheet material is produced either by staggering the prepared lengths of material or by guiding them together in an offset manner. Most common are interfolders which process two lengths and produce sheets which have only one fold and are placed on one another in a U shape. In this type, the sheets of the two lengths of material are placed one on top of the other in such a way that they are staggered with respect to one another by half a sheet in length.

In order to make full use of the productivity of the interfolders of the prior art type, it is necessary for them to be followed by a semi-automatic or fully-automatic packaging arrangement. This gave rise to the requirement for the sheet stacks which are continuously produced by the zigzag folding to be divided into numerically correct partial stacks which are then packaged. For this purpose, depending upon the machine cycle and the predetermined lot size of the partial stacks, separating or supporting elements are introduced from the side into the sheet stack and a partial stack is separated from the sheet stack. In order to achieve the most accurately possible division of the sheet stack into numerically correct partial stacks, it is advisable to carry out separation directly upon formation of the stack; that is, immediately downstream from the folding rollers. Separations of this type generally operate satisfactorily. However, problems occur at the moment when the downstream front sheet of the sheet stack and the upstream rear sheet of the partial stack, which are interfolded, are to be separated without disruption. This then leads to difficulties and disruptions, particularly when partial stacks with small lot sizes have to be formed at high production capacities by the interfolder.

In order to solve problems of this type, there have already been proposals, such as in U.S. Pat. No. 4,717,135 and in EP-O 291,211 A 2, in which small gaps are created by folding back advancing sheet parts onto the sheet itself in the individual sheet streams. In this way, interfolding of the sheets corresponds to a plane of separation, so that the actual separating operation is simplified.

However, it has been found in practice with modern high-capacity interfolders that this small gap is not sufficient for a simple separating operation. Even a high expenditure on control technology and machinery which is urgently required as a result does not guarantee reliable separation of numerically correct partial stacks. Folding back, or round folding, of several sheets, which might be proposed as a possible solution, cannot be carried out. The material thickness produced in these operations with the combined lengths of material is limited by the width of the folding gap between the folding rollers, since this needs to be as narrow as possible in order to achieve a good quality fold. In addition, this possible solution has the inherent danger that when several sheets are folded back, or folded round, they are shifted out of register with respect to one another and to the rest of the series of sheets. This would inevitably lead to disruptions in the taking up, the transporting, and the zigzag folding.

SUMMARY OF THE INVENTION

It is an object of the invention to provide a method and an interfolder apparatus for carrying out the method which permits a problem-free and reliable division of a stack of sheet material which is continuously produced by zigzag folding into numerically correct partial stacks. These desired results are provided even with high production capacities in combination with partial stacks of small lot sizes. In addition, the expenditure on control technology and machinery is to be kept as low as possible.

The above objects are accomplished in accordance with the present invention by providing a method of producing numerically correct partial stacks of individual sheets which are of U-shape or zigzag-shape and which are interfolded so as to overlap, comprising providing at least one continuously moving length of material; producing at least one continuously produced stream of neighboring sheets of equal length from the at least one continuously moving length of material by cross-separation or cross-perforation; providing a double stream of these sheets; the double stream being guided together and staggered, so that neighboring sheets lying opposite to one another are offset with respect to one another; forming a gap in the stream by removing at least one removable sheet; continuously folding the double stream in U-shape or zigzag shape; piling up the double stream in the form of a stack; dividing the stack which is continuously being formed into numerically correct partial stacks; and separating off the partial stacks from the stack by the introduction of separating elements in a separating zone of the stack.

In addition, the present invention provides an apparatus for producing numerically correct partial stacks comprising a pair of feed rollers for supplying a double stream length of material; a cross-separating or cross-perforating means for defining a cutting gap; a pair of folding rollers running in the opposite direction and defining a folding gap for zigzag folding of the double stream to form a stack; a shaft arranged after the double stream and receiving the stack; distributors which are coordinated with the pair of folding rollers and which are arranged on both sides of the shaft; a separating means which is arranged downstream of the pair of folding rollers and which can be introduced into the stack from the side; a storage table which goes into the shaft; and at least one removing means arranged between the cutting gap and the folding gap and tangent to the double stream.

The advantages achieved reside, in particular, in that before the zigzag folding using relatively simple means, the formation of sufficiently large gaps in the sheet streams is possible. This substantially simplifies the subsequent separating operation. In this way, an absolutely reliable separation of the continuously formed partial stacks of the sheet material into numerically correct partial stacks is possible. The formation of a sufficiently large gap not only prevents interfolding of the sheets which are adjacent in the plane of separation provided, but it also ensures that, even with high production capacities of the interfolder combined with the formation of partial stacks of small lot sizes, there is sufficient time available for the introduction of separating and supporting means into the sheet stack. This measure also reduces the expenditure on control technology and machinery for the separating and supporting means. This is not difficult to recognize in comparison with other interfolders, e.g., that described in U.S. Pat. No. 4,770,402. It has also proved advantageous that the sheets removed in order to form a gap are stored for a time. Then these are delivered back to the sheet stream individually one after the other in such a way that they come to lie congruently on corresponding sheets and the alternative exists of placing them at the end of the beginning region of a partial stack.

BRIEF DESCRIPTION OF THE DRAWINGS

Other objects and features of the present invention will become apparent from the following detailed description considered in connection with the accompanying drawing which discloses a few embodiments of the present invention. It should be understood, however, that the drawing is designed for the purpose of illustration only and not as a definition of the limits of the invention.

DETAILED DESCRIPTION OF THE PREFERRED EMBODIMENTS

Figure 1:
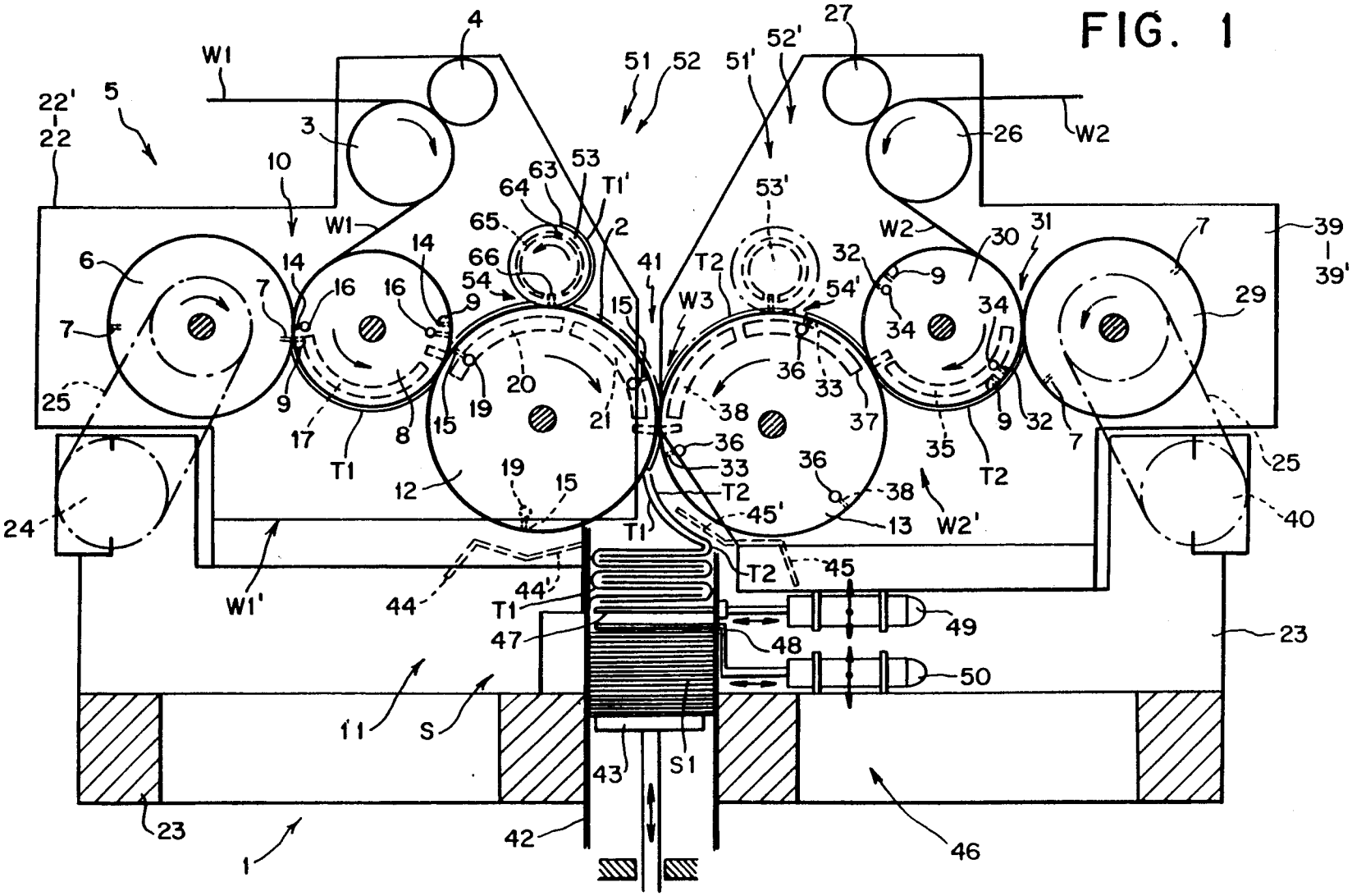
FIG. 1 shows a side view of the interfolder of the invention.

A machine for producing sheets which are interleaved in a U-shape or are interfolded in a zigzag form, comprises essentially an unrolling station, processing apparatus with a storage area, designated hereafter as an interfolder, and a packaging station arranged after it. In the drawing only the interfolder 1, which is of interest for the invention, is illustrated.

In order to produce the interfolded sheets T1, T2, the interfolder 1 shown in FIG. 1 processes two lengths of material W1, W2. The length of material W1 is drawn from a left-hand pair of feed rollers 3, 4 to a left-hand cross-separating arrangement 5. This includes a blade roller 6 bearing cross-separating blades 7 and a cutter roller 8 equipped with counterblades 9 which cooperate with the cross-separating blades 7. The blade roller 6 and the cutter roller 8 form a common roller gap 10, in which the length of material W1 is divided into sheets T1 of equal length, which are then delivered as a continuous stream W1' to a left-hand folding roller 12 of a pair 11 of folding rollers. In order to grip and transport the sheets T1, the cutter roller 8 and the folding roller 12 are equipped with radially arranged suction air openings 14 and 15 respectively. The suction air opening 14 is in air-duct communication with a suction air control channel 17 via a cross-bore 16, while the suction air opening 15 is connected by a cross-bore 19 to suction air control channels 20 or 21. The rollers 3, 4, 6, 8 and 12 are rotatably mounted in common sliding walls 22, 22', which are movably mounted on a lower frame of the machine 23. They are driven in rotation by a miter gear 24, a roller drive chain 25 and wheel arrangements which are not shown. The particular direction of rotation of each one is shown by the arrows in FIG. 1.

The length of material W2 is delivered at the same speed to the interfolder 1 and is further processed there like the length of material W1. In this case, it is drawn from a right-hand pair of feed rollers 26, 27 to a right-hand cross-separating arrangement 28. This comprises a blade roller 29 bearing cross-separating blades 7 and a cutter roller 30 equipped with counterblades 9, which cooperate with the cross-separating blades 7. The blade roller 29 and the cutter roller 30 form a common roller gap 31, in which the length of material W2 is divided into sheets T2 of equal length. Sheets T2 are then delivered as a continuous stream W2' to a right-hand folding roller 13 of the pair 11 of folding rollers. In order to grip and transport the sheets T2, the cutter roller 30 and the folding roller 13 are equipped with radially arranged suction air openings 32 and 33 respectively. The suction air opening 32 is in air-duct communication with a suction air control channel 35 via a cross-bore 34, while the suction air opening 33 can be supplied with suction air via a cross-bore 36 from the suction air control channels 37 or 38. The rollers 26, 27, 29, 30 and 13 are rotatably mounted in common sliding walls 39, 39', which are movably mounted on a lower frame of the machine 23. They are driven in rotation by a miter gear 40, a roller drive chain 25 and wheel arrangements which are not shown. The particular direction of rotation of each one is shown by the arrows in FIG. 1.

The folding rollers 12, 13 of the pair of folding rollers 11 form a common folding gap 41, which can be varied in width by displacing the sliding walls 22, 22' and 39, 39'. The streams W1' and W2' are guided together in the folding gap 41, forming a double stream W3, so that the sheets T1 of the stream W1' are staggered by half a sheet length with respect to the sheets T2 of the stream W2'. The double stream W3 is then folded in zigzag form and piled up into a continuously growing stack S. The sheets T1, T2, which have been given a central fold 101 or 102, respectively, by the folding operation, are interleaved in such a way that the folds 101 always face towards the left and the folds 102 always face towards the right. The beginning and end of each of the sheets T1 or T2, which are adjacent in a stream W1' or W2', respectively, come to rest, in each case, in the central fold 102 or 101 of the sheets T2 or T1, respectively of the opposing steam W2' or W1'. For the formation of the folds, the folding rollers 12, 13 are provided with additional air intake gripping arrangements which are not essential to the invention and, for the sake of clarity, are not included in the drawings, although they are mentioned briefly here for the sake of completeness.

A shaft 42, in which a stack table 43 which is vertically movable upwardly and downwardly is located, is arranged centrally with respect to the folding gap 41 underneath the pair 11 of folding rollers. A left-hand distributor 44 and a right-hand distributor 45 are arranged laterally adjacent to the shaft 42 and below the folding rollers 12, 13. The distributors 44, 45 are of comb-like construction and in the machine cycle they carry out working movements in which they engage with their front ends 44' and 45', respectively, both in the folding rollers 12 and 13 and also in the shaft 42. For this purpose, the folding rollers 12, 13 have annular grooves 12', 13' and the shaft 42 has vertical slots. The distributors 44', 45 are controlled as regards time in the course of their movement in such a way that they work offset from one another. In this way, the folds 101 of the sheets T1 and the folds 102 of the sheets T2, which are formed alternately in the zigzag folding are taken off of the folding rollers 12 or 13 by the distributors 44 or 45 in the correct sequence and are pushed downwards with the sheets T1, T2 into the shaft 42. In the shaft 42, the sheets T1, T2 are then piled up by means of the stack table 43 into a stack S, the stack table 43 being moved downwards depending upon the number of interfolded sheets T1, T2. After a predetermined number of sheets T1, T2, a separating arrangement 46 is introduced into the stack S from the side. By means of this separating arrangement, a partial stack S1 of predetermined size can be separated from the stack S.

In a simple construction, the separating arrangement 46 has two horizontally movable forks 47, 48, which are mounted on displacement devices 49, 50, which are arranged so as to be vertically movable on guide elements which are not shown. In order to separate off one partial stack S1, the forks 47, 48 travel from one common starting position into the stack S in the same horizontal plane. After this, the fork 47 briefly assumes the function of the stack table 53 and supports the stack S which is continuously being built up, and, at the same time, the fork is moved downwards. The partial stack S1, which has been separated off, is moved rapidly downwards jointly with the stack table 43 and the fork 48, and from there, the partial stack S1 is taken over by a conveyor arrangement which is not shown. The fork 48 is then withdrawn from the shaft 42, and the stack table 43 is moved upwards below the fork 47. The latter is also withdrawn from the shaft 42 and afterwards travels back with the fork 48 upwards into their common starting position.

Figure 4:
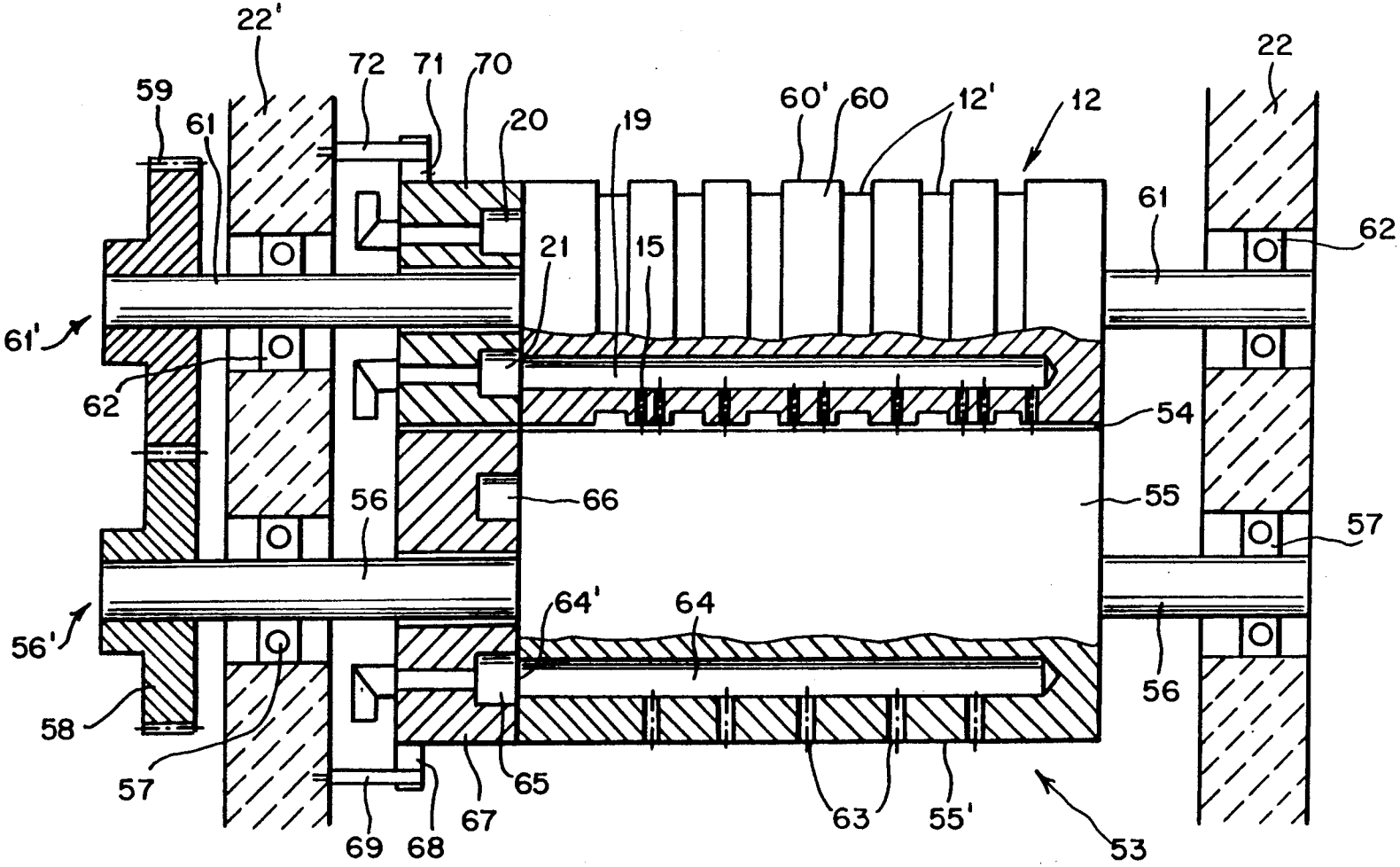
FIG. 4 shows a storage and a folding roller in half-section.

In order for a partial stack S1 to be separated off without problems, it is desirable if, according to the desired number of sheets T1, T2 in the stack S1, a gap 2 is arranged between the partial stack S1 and the remaining stack S. The result of this is that the sheets T1, T2 in the plane of separation are not interfolded, so that the forks 47, 48 of the separating arrangement 46 can pass through the stack S from the side. An arrangement for forming gaps 2 is shown in FIG. 1. It is a removal arrangement 51 which is constructed as a storage arrangement 2. In the embodiment which is illustrated in FIGS. 1 and 4, this storage arrangement 52 is constructed as a storage roller 53. The storage roller 53 is arranged on the folding roller 12 upstream of the folding gap 41, tangent to the stream W1', these two rollers forming a common removing and returning gap 54. As FIG. 4 shows, the storage roller 53 has a cylindrical main body 55, the rolling circumference of which corresponds to the distance between corresponding edges of neighboring sheets T1. The main body 55 is mounted coaxially and so as to be fixed against rotation on a shaft 56 which is rotatably mounted in the sliding walls 22, 22' by means of ball bearings 57 and securing elements which are not shown. A toothed wheel 58, which is arranged so as to be fixed against rotation on one end of the shaft 56', engages in a toothed wheel 59, which is arranged so as to be fixed against rotation on the folding roller 12.

The folding roller 12 also has a cylindrical main body 60, and in its casing 60' are arranged the annular grooves 12' in which the distributor 44 engages. The main body 60 is mounted coaxially and so as to be fixed against rotation on a shaft 61 which is rotatably mounted in the sliding walls 22, 22' by means of ball bearings 62 and securing elements which are not shown. The toothed wheel 59 is mounted so as to be fixed against rotation on one end of the shaft 61'.

The number of teeth on the toothed wheels 58 and 59 are chosen so that the storage roller 53 is driven in the machine cycle, that is to say that it rotates once per sheet T1. In order to grip sheets T1, the storage roller 53 has in the casing 55' of its main body 55 suction air openings 63 which open into a cross-bore 64 which is moved with its end opening 64' past control channels 65 and 66 during the rotary movement of the storage roller 53. While the control channel 65 can be supplied with suction air, the channel 66 is continuously connected to atmospheric air pressure. The control channels 65, 66 are arranged in a control valve which is rotatably mounted on the shaft 56, but is fixed to the sliding wall 22' by means of a holder 68 and a bolt 69, so as to be fixed against rotation. The suction air control channels 20, 21, which are described above for the folding roller 12, are arranged in a control value 70 which is rotatably mounted on the shaft 61, but is fixed by means of a holder 71 and a bolt 72 to the sliding wall 22', so as to be fixed against rotation.

In normal transport operation, the folding roller 12 with its air intake openings 15 picks up the downstream edges of the sheets T1 and moves the sheets T1 to the folding gap 41. For this, the suction air openings 15 are supplied with suction air via the cross-bore 19 of the suction air control channels 20, 21.

In order to form a gap 2 in the stream W1', the suction air control channel 21 is connected to atmospheric air pressure for one machine cycle, while simultaneously, the control channel 65 of the storage roller 53 is supplied with suction air for one machine cycle. In this way, a specific sheet T1' is gripped in the removing and returning gap 54 by the storage roller 53 by means of its suction air openings 63, and a gap 2 is formed in the stream W1'. After one rotation of the storage roller 53, the control channel 65 thereof is connected to atmospheric air pressure, and the control channel 21 of the folding roller 12 is again supplied with suction air. The sheet T1' is thereby placed accurately in position on the sheet T1 which follows it. Both are then delivered together to the folding gap 41.

The accurate supply of suction air and aerating of the control channels 21 and 65 which is necessary for the formation of a gap 2 takes place in the machine cycle and depends upon the desired number of sheets T1, T2 in the partial stacks S1.

This control function is advantageously assumed by a control valve which is arranged before the control valves 67, 70 and carries out a switch function. Valves of this type are known, and U.S. Pat. No. 4,714,394 discloses such an example in the prior art.

A storage roller 53' which is arranged on the folding roller 13 and the stream W2' is shown in dash-dot lines in FIG. 1. The storage roller 53' can replace the storage roller 53 or can cooperate therewith.

Figure 6:
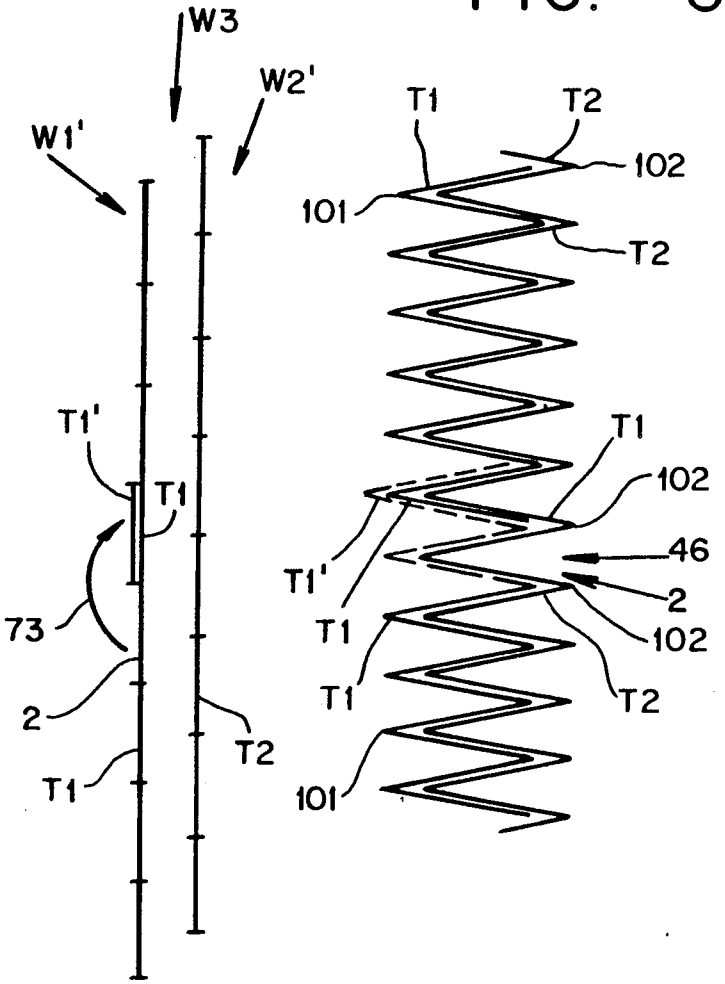
FIG. 6 shows a double stream with a simple gap before and after the zigzag-shaped folding.

In FIG. 6, the double stream W3 is shown before and after the zigzag folding. A gap 2 is formed in the stream W1' of the double stream W3 by means of the storage roller 53 described above. The arrow 73 indicates that the sheet T1', which is stored for a brief time, has been placed on the following sheet T1, so that a gap 2 is produced. After the zigzag-shaped folding, the sheets T1, T2 are interleaved, except in the region of the gap 2 in which the separating device 46 engages during the separating operation.

It is advantageous if for the formation of a gap 2, one more sheet T1 is removed in the stream W1' opposite the separating arrangement 46 than in the stream W2' facing the separating arrangement 46. This ensures that the separating arrangement 46 moves into the stack S from the side on which two fold edges 102 (101) define the gap 2.

Figure 2:
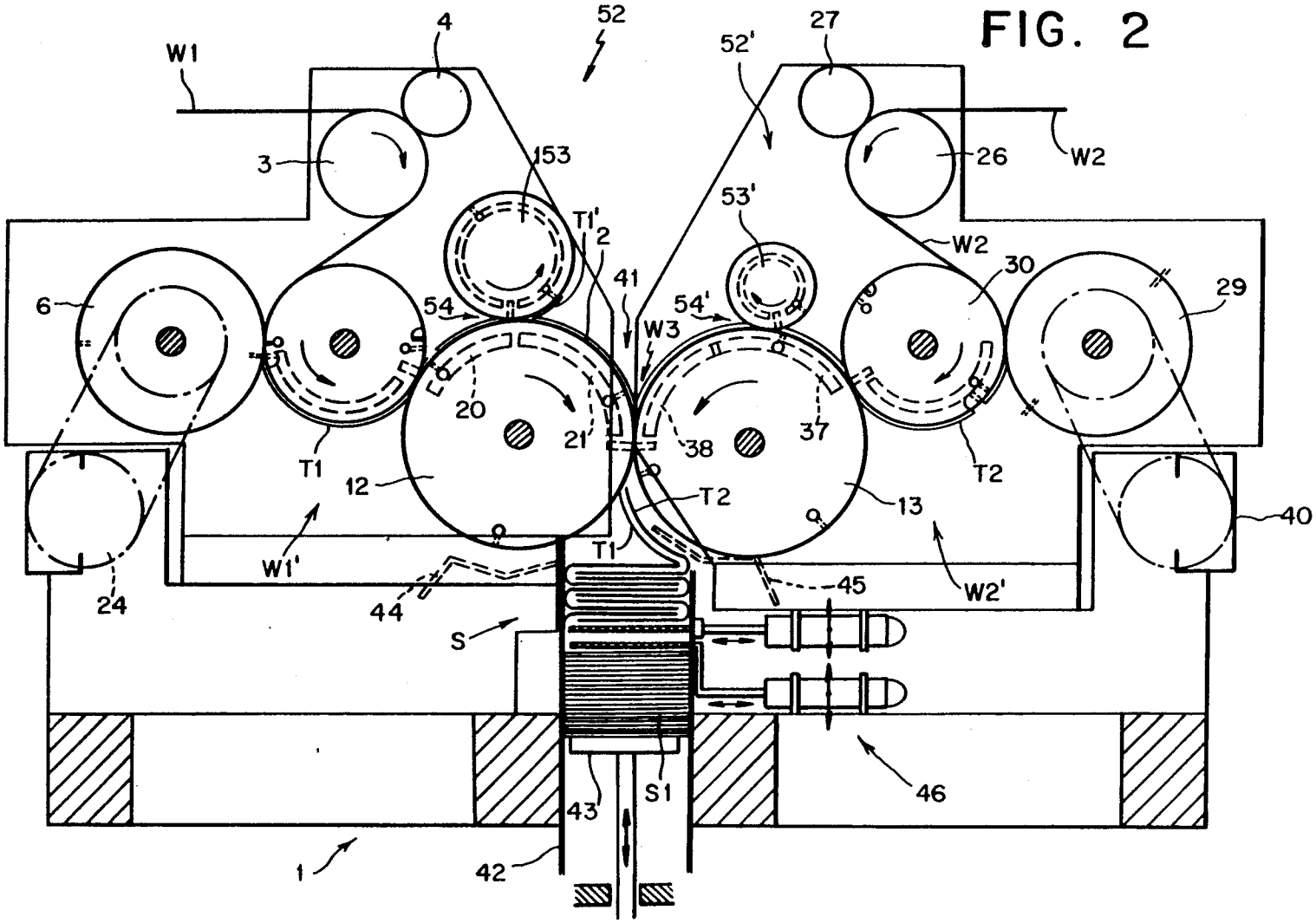
FIG. 2 shows a side view of a second embodiment of an interfolder with two storage arrangements of differing sizes.
Figure 7:
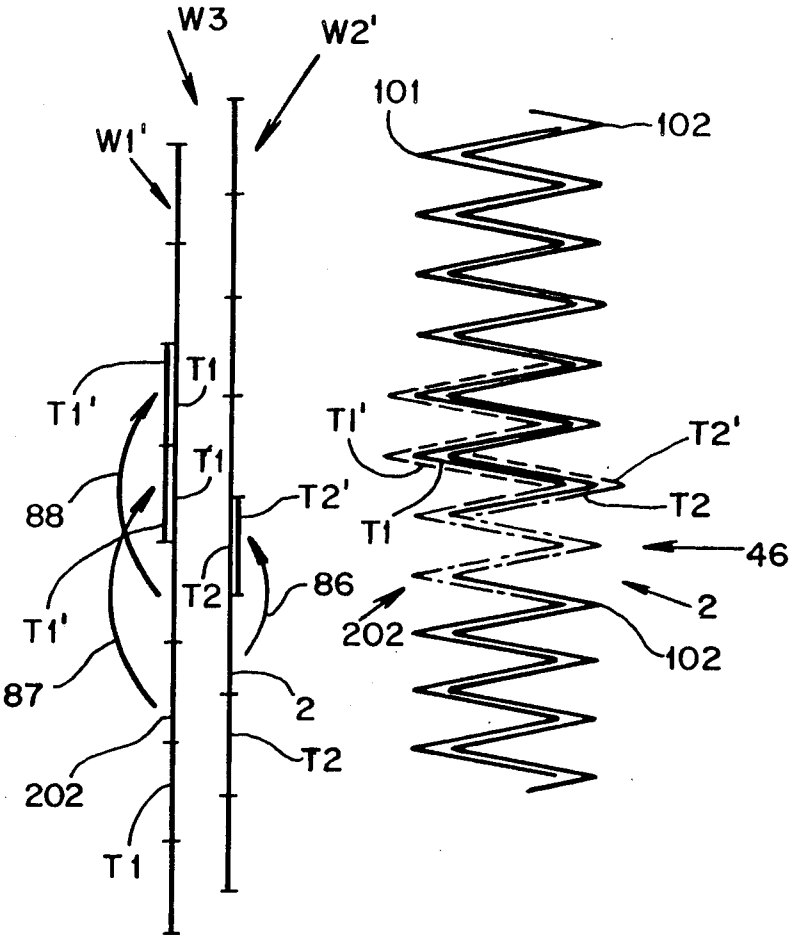
FIG. 7 shows a double stream with an enlarged gap before and after the zigzag-shaped folding.

A second embodiment of an interfolder 1, which includes the structure and features set out in the aforementioned description, is shown in FIG. 2. Upstream of the folding gap 41, a storage roller 153 is arranged on the folding roller 12, so as to be tangent upon the stream W1'. Its diameter is twice as great as that of the storage roller 53', which is arranged upstream of the folding gap 41 on the folding roller 13, so as to be tangent to the stream W2'. The storage rollers 153 and 536 function and are constructed in a similar manner to the storage roller 53. In order to form a gap 2, one sheet T2' is removed from the stream W2' by the storage roller 53' and is placed accurately in position on the following sheet T2. In order to form a gap 202, on the other hand, two adjacent sheets T1' are removed from the stream W1' by the storage roller 153 and are placed accurately in position on the two sheets T1 which immediately follow the gap 202. Larger gaps 202, 2 formed in this way are shown in FIG. 7. The arrows 86 or 87, 88 indicate the direction in which the sheet T2' or the sheets T1' have been moved in order to form a gap 2 or 202. The larger gaps 202, 2 which are present after the zigzag folding of the double stream W3 make it possible to insert the separating arrangement 46 into the stack S, even with the highest production capacities of the interfolder 1.

Figure 3:
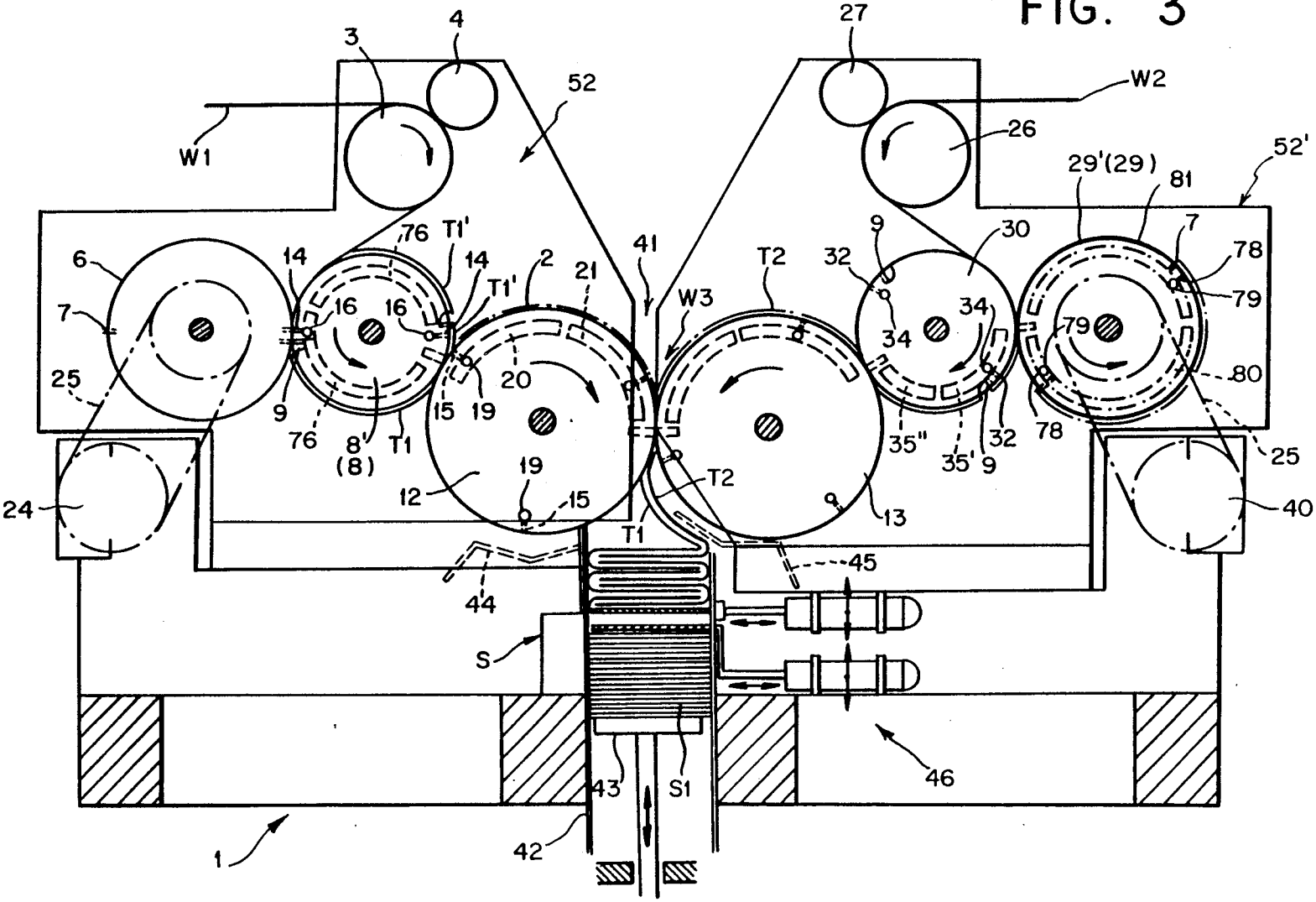
FIG. 3 shows a side view of a third embodiment of an interfolder in which the cutter roller, or the blade roller, is constructed as a storage arrangement.

A third embodiment showing storage arrangements 52, 52' is illustrated in FIG. 3. A modified cutter roller 8 or a modified blade roller 29 is constructed at the same time as storage rollers 8' or 29'.

The cutter roller 8 requires an additional suction air control channel 76. In order to form a gap 2 in the stream W1', the control channel 76 is supplied with suction air, and the suction air control channel 20 of the folding roller 12 is simultaneously connected to the atmospheric air pressure. Thus, specific sheets T1 remain fixed on the cutter roller 8', are guided in a circular movement below the length of material W1 and there come to rest accurately in position below a sheet T1 which is still to be separated off. While this sheet T1 is being separated from the length of material W1, the suction air control channel 76 is connected to the atmospheric air pressure, and the suction air control channel 20 is again supplied with suction air. The sheets T1, T1', which lie doubled, are then picked up together by the folding cylinder 12 and delivered to the folding gap 41.

By means of additional suction air elements, the blade roller 29 can also assume the function of a storage roller 29'. For this purpose, it is equipped behind the blades 7 (when viewed in the direction of rotation) with suction air openings 78 which ca be brought into airduct communication with suction air control channels 80, 81 via a cross-bore 79. In addition, the suction air control channel 35 of the cutter roller 30 is divided into two suction air control channels 35' and 35''. In order to form a gap 2 in the stream W2', the suction air control channels 80, 81 are supplied with suction air, while, at the same time, the suction air control channel 35' is connected to atmospheric air pressure. Thus, before being separated, sheets T2' are picked up by means of the suction air openings 78 and fixed on the blade roller 29'. The separated sheets T2' are then guided onto the length of material W2 and there placed accurately in position on the next sheets T2 to be cut off. For this purpose, the suction air control channels 80, 81 are connected to atmospheric air pressure, and the suction air control channel 35' is again supplied with suction air. The sheets T2, T2', which lie double, are then delivered to the folding gap 41 by means of the cutter roller 30 and the folding roller 13.

Figure 5:
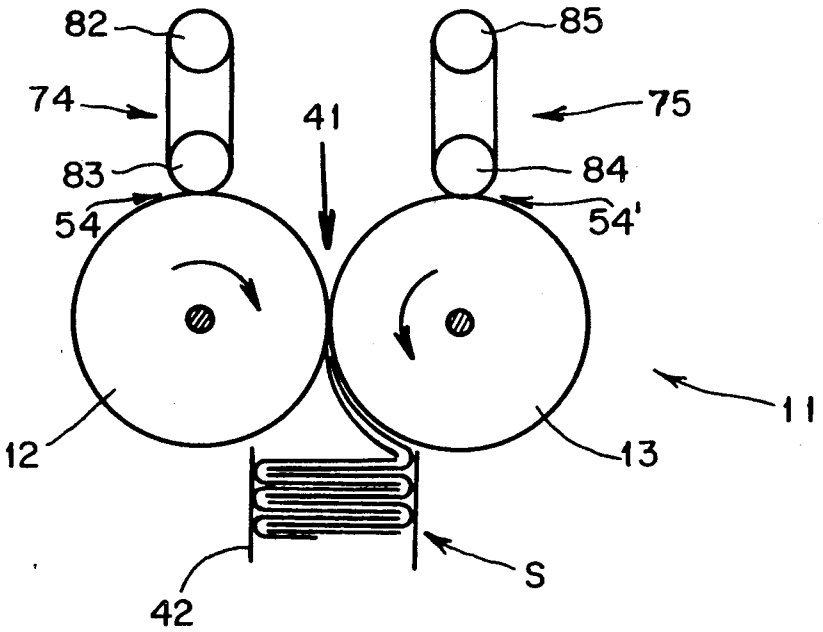
FIG. 5 shows storage belts as a storage arrangement.

Storage belts 74 and 75 are shown in greatly simplified representation in FIG. 5. The storage belt 74 runs around guide rollers 82 and 83 and forms with the folding roller 12 a common removing and returning gap 54. The storage belt 75 runs around guide rollers 84 and 85 and forms with the folding roller 13 a common removing and returning gap 54'. The storage belts 74, 75 are preferably equipped with intake air gripping elements (not shown). Their function, in principal, is similar to that of the storage roller 53.

The present invention is not limited to the embodiments illustrated in the drawings, since many other alterations and additions could be made, without deviating from the fundamental idea of the invention. Thus, for example, in one embodiment, there can be only one belt or roller storage arrangement which is tangent to the stream W1' and the stream W2' and which can receive, store and return both sheets T1' and sheets T2'. A further embodiment is to provide two storage arrangements 52, 52' on a folding roller 12 or 13. Thus, it is possible to place several sheets T1' or T2' accurately in position on a cloth T1 or T2 in order, thus, to form a larger gap 2.

While only a few embodiments of the present invention have been shown and described, it is to be understood that many changes and modifications may be made thereunto, without departing from the spirit and scope of the invention as defined in the appended claims.

What is claimed is:

1. A method of producing numerically correct partial stacks of individual sheets which are of U-shape or zigzag-shape and which are interfolded so as to overlap, comprising:

providing at least one continuously moving length of material;

producing at least one continuously produced stream of neighboring sheets of equal length from said at least one continuously moving length of material by cross-separation or cross-perforation;

providing a first produced stream and a second produced stream;

said double stream being guided together and staggered, so that neighboring sheets lying opposite to one another are offset with respect to one another;

forming a gap in one of the streams by removing at least one removable sheet;

temporarily storing sheets which have been removed from the continuously produced stream;

afterwards returning said removed sheets to the stream by placing the removed sheets on the sheets of the first produced stream or on the sheets of the second produced stream in such a way that the first neighboring and first removed sheets or the second neighboring and second removed sheets are aligned congruently with respect to one another;

continuously folding said double stream in U-shape or zigzag shape;

piling up said double stream in the form of a stack;

dividing the stack which is continuously being formed into numerically correct partial stacks; and separating off said partial stacks from said stack by the introduction of separating elements in a separating zone of the stack.

2. A method as claimed in claim 1, further comprising storing temporarily the sheets removed from the first and second continuously produced streams; and afterwards delivering said removed sheets during the machine cycle to the length of material, so that they are aligned congruently with respect to the neighboring sheets which are to be separated off.

3. A method as claimed in claim 2, further comprising guiding the neighboring sheets underneath the length of material.

4. A method as claimed in claim 2, further comprising guiding the neighboring sheets on the length of material.

5. A method as claimed in claim 3, further comprising moving the neighboring sheets on an equal circular path during cross-separation or cross-perforation, interim storage and returning to the length of material.

6. A method as claimed in claim 2, further comprising placing several removable sheets on a neighboring sheet.

7. A method of producing numerically correct partial stacks of individual sheets which are of U-shape or zigzag-shape and which are interfolded so as to overlap, comprising:

providing at least one continuously moving length of material;

producing at least one continuously produced stream of neighboring sheets of equal length from said at least one continuously moving length of material by cross-separation or cross-perforation;

providing a double stream of these sheets;

said double stream being guided together and staggered, so that neighboring sheets lying opposite to one another are offset with respect to one another;

creating a gap in the zigzag folding of the stream by removing at least one removable sheet;

temporarily storing sheets which have been removed from the continuously produced stream;

afterwards returning said removed sheets to the stream by placing the first removed sheets one after the other, individually and congruently, on the first neighboring sheets and placing the second removed sheets one after the other, individually and congruently, on the second neighboring sheets;

continuously folding said double stream in U-shape or zigzag shape;

piling up said double stream in the form of a stack;

dividing the stack which is continuously being formed into numerically correct partial stacks; and separating off said partial stacks from said stack by the introduction of separating elements in a separating zone of the stack.

8. A method as claimed in claim 7, comprising directly placing the first or second removed sheets on the first or second neighboring sheets following the gap.

9. A method as claimed in claim 7, comprising placing the first or second removed sheets on the first or second neighboring sheets which are arranged immediately before the next gap.

10. A method as claimed in claim 7, further comprising introducing separating elements into the gap in the zigzag folding of the double stream in order to divide up the stack.

11. A method of producing numerically correct partial stacks of individual sheets which are of U-shape or zigzag-shape and which are interfolded so as to overlap, comprising:

providing at least one continuously moving length of material;

producing at least one continuously produced stream of neighboring sheets of equal length from said at least one continuously moving length of material by cross-separation or cross-perforation;

providing a double stream of these sheets;

said double stream being guided together and staggered, so that neighboring sheets lying opposite to one another are offset with respect to one another;

forming a gap in the stream by removing at least one removable sheet;

temporarily storing the removable sheets of the continuously produced streams by the same storage device;

afterwards delivering said removable sheets, as required, to the first continuously produced stream or to the second continuously produced stream;

continuously folding said double stream in U-shape or zigzag shape;

piling up said double stream in the form of a stack;

dividing the stack which is continuously being formed into numerically correct partial stacks; and separating off said partial stacks from said stack by the introduction of separating elements in a separating zone of the stack.

12. A method of producing numerically correct partial stacks of individual sheets which are of U-shape or zigzag-shape and which are interfolded so as to overlap, comprising:

providing at least one continuously moving length of material;

producing at least one continuously produced stream of neighboring sheets of equal length from said at least one continuously moving length of material by cross-separation or cross-perforation;

providing a double stream of these sheets;

said double stream being guided together and staggered, so that neighboring sheets lying opposite to one another are offset with respect to one another;

forming a gap in the stream by removing at least one removable sheet;

temporarily storing sheets which have been removed from the continuously produced stream;

returning the removable sheets which had been removed for the formation of a first gap to the continuously produced stream after a second gap following the first gap;

continuously folding said double stream in U-shape or zigzag shape;

piling up said double stream in the form of a stack;

dividing the stack which is continuously being formed into numerically correct partial stacks; and separating off said partial stacks from said stack by the introduction of separating elements in a separating zone of the stack.

13. An apparatus for producing numerically correct partial stacks comprising:

a pair of feed rollers for supplying a double stream length of material;

a cross-separating or cross-perforating means for defining a cutting gap;

a pair of folding rollers rotating in the opposite direction of each other and defining a folding gap for zigzag folding of the double stream to form a stack;

a shaft arranged after the double stream and receiving the stack;

distributors which are coordinated with the pair of folding rollers and which are arranged on both sides of the shaft;

a separating means which is arranged downstream of the pair of folding rollers and which can be introduced into the stack from the side;

a storage table which goes into the shaft; and at least one removing means arranged between the cutting gap and the folding gap and tangent to the double stream, said removing means including a storage arrangement means for receiving, storing and returning the neighboring sheets;

means for activating said at least one removing means depending upon the machine cycle and a desired number of neighboring sheets in order to form a partial stack.

14. An apparatus as claimed in claim 13, wherein said storage arrangement means is constructed as a storage roller, or storage belt.

15. An apparatus as claimed in claim 13, wherein said cross-separating or perforating arrangement includes a cutter roller constructed as a storage roller.

16. An apparatus as claimed in claim 13, wherein said cross-separating or perforating arrangement includes a blade roller constructed as a storage roller.

17. An apparatus as claimed in claim 13, further comprising suction air gripping elements for said storage arrangement.

18. An apparatus as claimed in claim 14, wherein the storage roller or the storage belt, together with the folding rollers of the pair of folding rollers, form a common receiving and returning gap.

19. An apparatus as claimed in claim 13, further comprising several storage arrangement means for each continuously produced stream.

* * * * *